US005495901A

United States Patent [19]

Livingstone et al.

[11] Patent Number: 5,495,901

[45] Date of Patent: Mar. 5, 1996

[54] SURFACE ADJUSTABLE ADJUSTABLE BENT HOUSING

[75] Inventors: Raymond D. Livingstone, Edmonton; David Kutinsky, Nisku; Murray Wilson; Winston Smith, both of Edmonton, all of Canada

[73] Assignee: Canadian Downhole Drill Systems Inc., Alberta, Canada

[21] Appl. No.: 395,995

[22] Filed: Feb. 28, 1995

[51] Int. Cl.[6] ..... E21B 7/08; E21B 17/042

[52] U.S. Cl. ..... 175/74; 166/237; 175/320; 285/93; 285/184

[58] Field of Search ..... 175/74, 73, 61, 175/62, 320; 166/237; 285/184, 93

[56] References Cited

U.S. PATENT DOCUMENTS

| | | | |
|---|---|---|---|
| 5,029,654 | 7/1991 | Wilson et al. | 175/74 |
| 5,052,501 | 10/1991 | Wenzel et al. | 175/74 |
| 5,125,463 | 6/1992 | Livingstone et al. | 175/74 |
| 5,269,385 | 12/1993 | Siblis et al. | 175/74 |
| 5,343,966 | 9/1994 | Wenzel et al. | 175/74 |

*Primary Examiner*—Stephen J. Novosad

*Attorney, Agent, or Firm*—Anthony R. Lambert

[57] ABSTRACT

An adjustable bent housing for use in downhole drilling which includes a housing, mandrel, ring and locking mechanism. The housing has a housing central axis, a downward facing end face defining a plane whose normal is offset from the housing central axis, and an inner shoulder parallel to the downward facing end face. The mandrel has a mandrel central axis, a first end dimensioned to fit inside the housing and having a downward facing outer shoulder defining a plane whose normal is offset from the mandrel central axis. The ring is axially slidable on the mandrel, with a ring central axis and an upward facing end face defining a plane whose normal is offset from the ring central axis. A locking mechanism, a mandrel head threaded onto the mandrel, engages and disengages the upward facing end face of the ring with the downward facing end face of the housing and simultaneously engages and disengages the inner shoulder of the housing with the outer shoulder of the mandrel. Keys or like means are used to control the position of the ring on the mandrel in selected circumferential positions only. One of the keys may be differently sized from other keys. Preferably markings on the ring and housing are used indicate relative degrees of rotation of the housing in relation to the ring.

7 Claims, 15 Drawing Sheets

SURFACE ADJUSTABLE ADJUSTABLE BENT HOUSING

FIELD OF THE INVENTION

This invention relates to an adjustable bent housing for downhole drilling systems.

BACKGROUND AND SUMMARY OF THE INVENTION

U.S. Pat. No. 5,125,463 describes one of the most recent designs for adjustable bent subs. This design incorporates a single bend in the device, with the bend occurring between end faces of a housing and a sliding ring axially slidable on a mandrel. The housing has an inner shoulder. The mandrel extends into the housing and is capped with a locking cap whose end face abuts the inner shoulder of the housing. Tightening of a locking ring forces the locking cap against the inner shoulder of the housing and the sliding ring against the end face of the housing. The faces formed by the end face of the sliding ring, end face of the housing, inner shoulder and end face of the locking cap are all offset from a central axis of the device so that rotation of the parts in relation to each other results in a bend in the device.

While this design has proved useful, the tool is somewhat difficult to adjust and improper adjustment may result in an alignment problem that could lead to failure of the tool. The present invention provides an improvement on this prior art design that makes proper adjustment easier to achieve.

There is therefore provided in accordance with one aspect of the invention, an adjustable bent housing for use in downhole drilling which includes a housing, mandrel, ring and locking mechanism. The housing has a housing central axis, a downward facing end face defining a plane whose normal is offset from the housing central axis, and an inner shoulder parallel to the downward facing end face. The mandrel has a mandrel central axis, a first end dimensioned to fit inside the housing and having a downward facing outer shoulder defining a plane whose normal is offset from the mandrel central axis. The ring is axially slidable on the mandrel, with a ring central axis and an upward facing end face defining a plane whose normal is offset from the ring central axis. A locking mechanism, preferably a mandrel head threaded onto the mandrel, engages and disengages the upward facing end face of the ring with the downward facing end face of the housing and simultaneously engages and disengages the inner shoulder of the housing with the outer shoulder of the mandrel.

Keys or like means are preferably used to control the position of the ring on the mandrel in selected circumferential positions only. One of the keys may be differently sized from other keys to assure proper alignment. Preferably markings on the ring and housing are used indicate relative degrees of rotation of the housing in relation to the ring.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

The mandrel, housing and ring described here are all tubular at least to the extent required by drilling methods. Axial in relation to a tubular part of the device means in the direction of the axis of the tube. Circumferential means around the circumference of the tube. Downward is used to define one axial direction as opposed to the other direction. However, it should be appreciated that the tool could be operated upside down, so that downward would then mean upward. Inner in relation to a part means radially inward in relation to that part. Outer in relation to a part means radially outward in relation to that part.

The main components of the bent housing assembly consist of four pieces: a mandrel 20 (FIGS. 1A, 1B, 3–5B, 7–12 and 14, 15), housing 30 (FIGS. 2A, 2B, 3–5B, 7–12, 13A, 13B, 13C, 13D and 13F and 14, 15), kick ring 40 (FIGS. 6A–12, 13A, 13B, 13C, 13D, 13E and 14, 15) and a mandrel head 50 (FIGS. 9–12 and 14, 15) forming a locking means for engaging and disengaging the kick ring, housing and mandrel with and apart from each other.

Figure 1A:
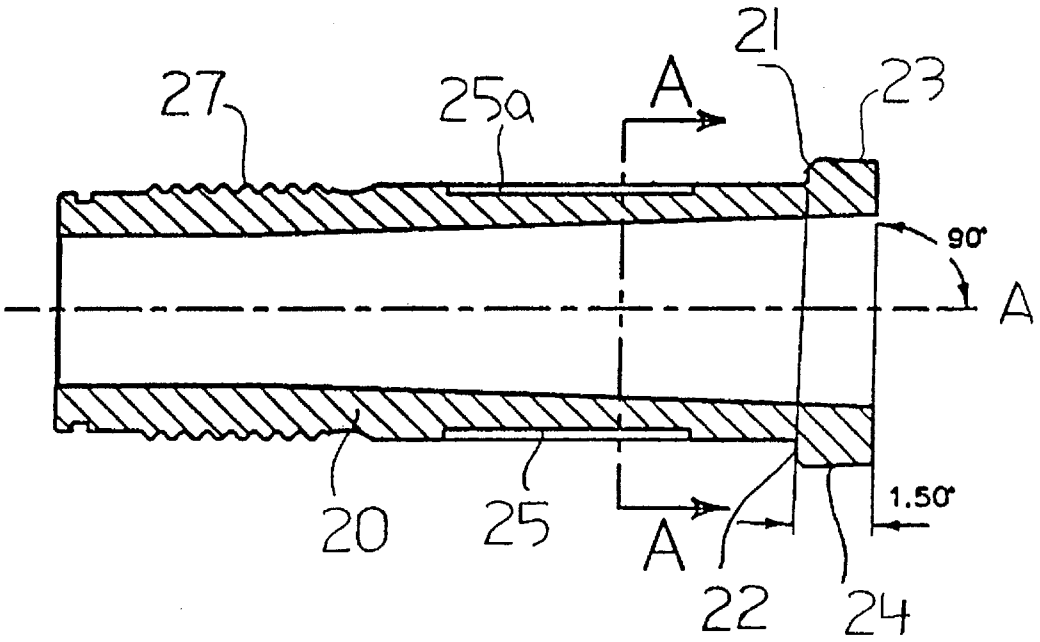
FIG. 1A is a longitudinal section through a mandrel according to the invention.
Figure 1B:
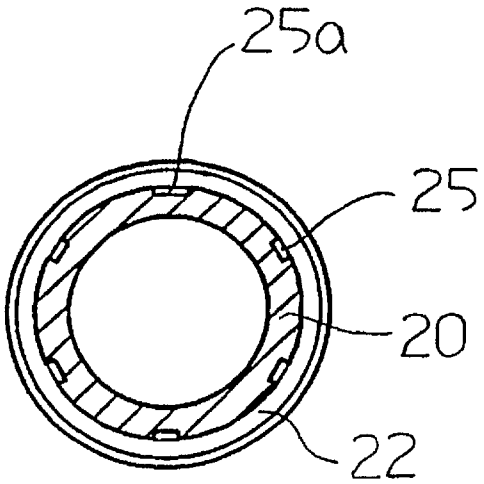
FIG. 1B is a cross-section through the mandrel of FIG. 1A along the line A—A in FIG. 1A.
Figure 2A:
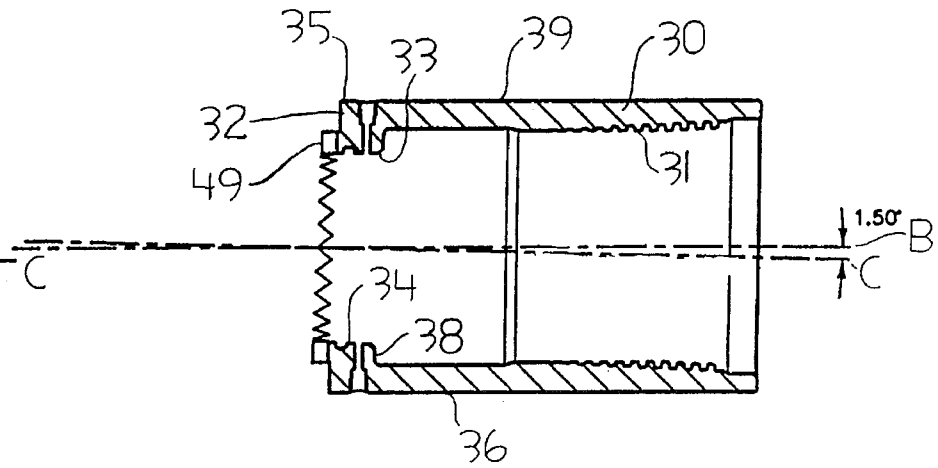
FIG. 2A is a longitudinal section through a housing according to the invention.
Figure 2B:
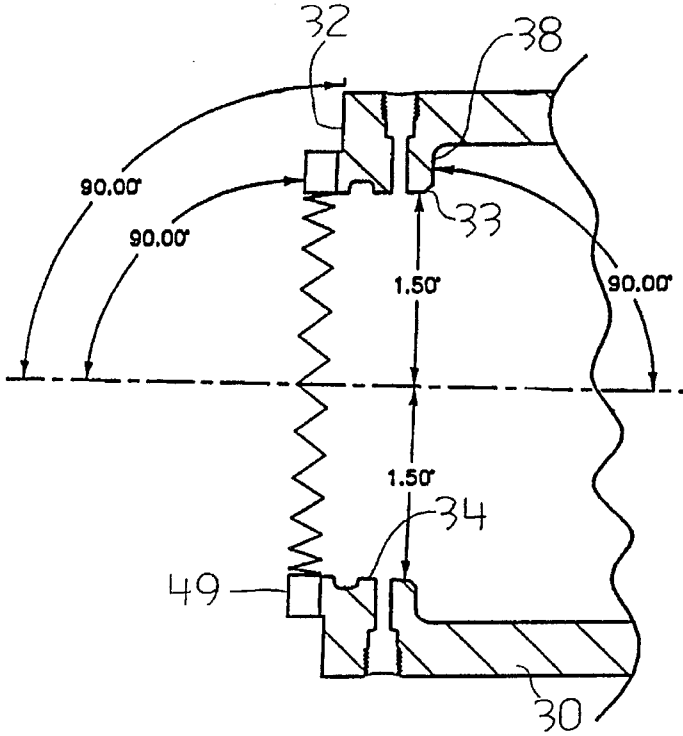
FIG. 2B is a detail of one end of the housing of FIG. 2A.
Figure 3:
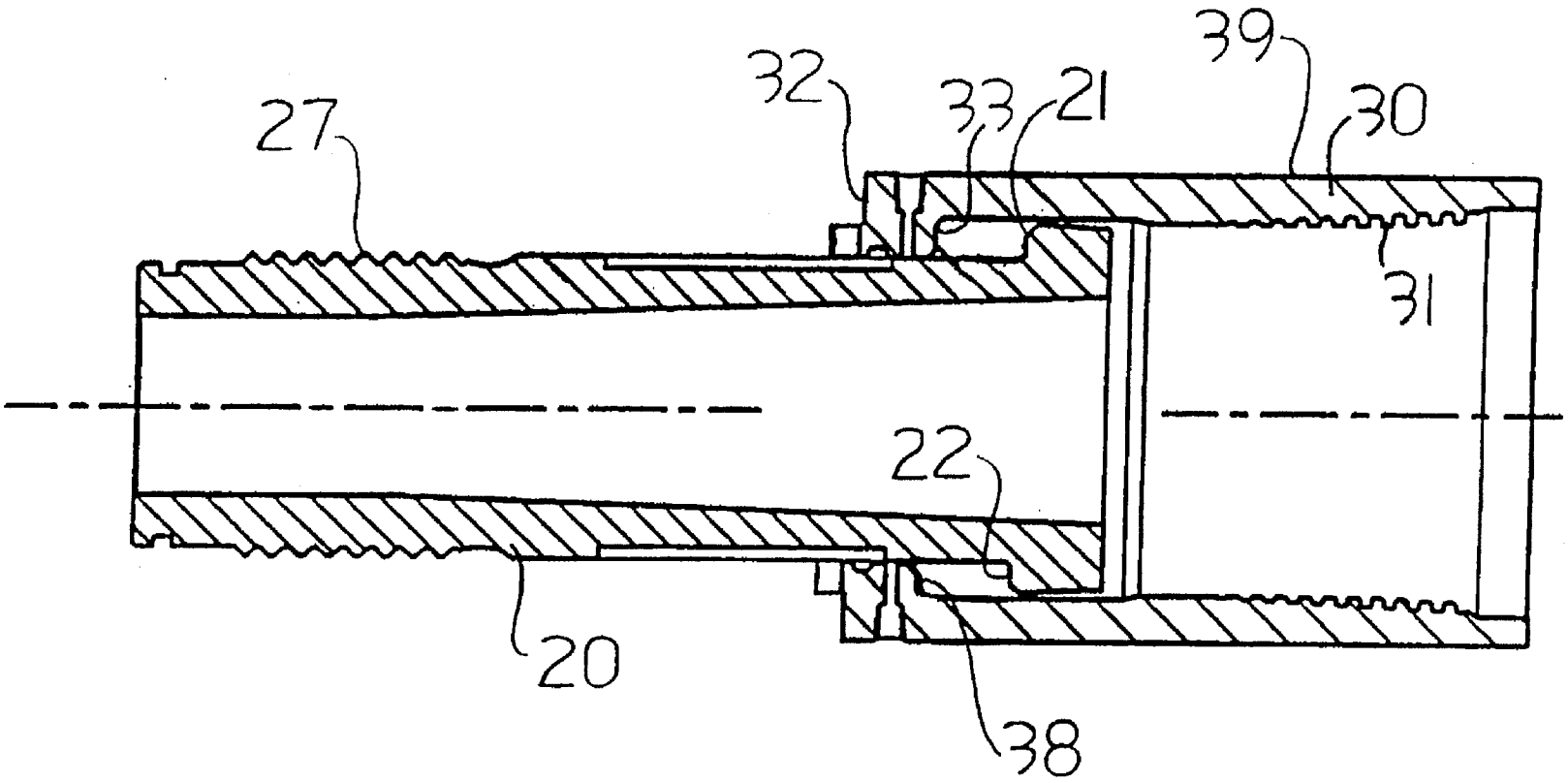
FIGS. 3 and 4 show longitudinal sections of mandrel and housing in two different positions.
Figure 4:
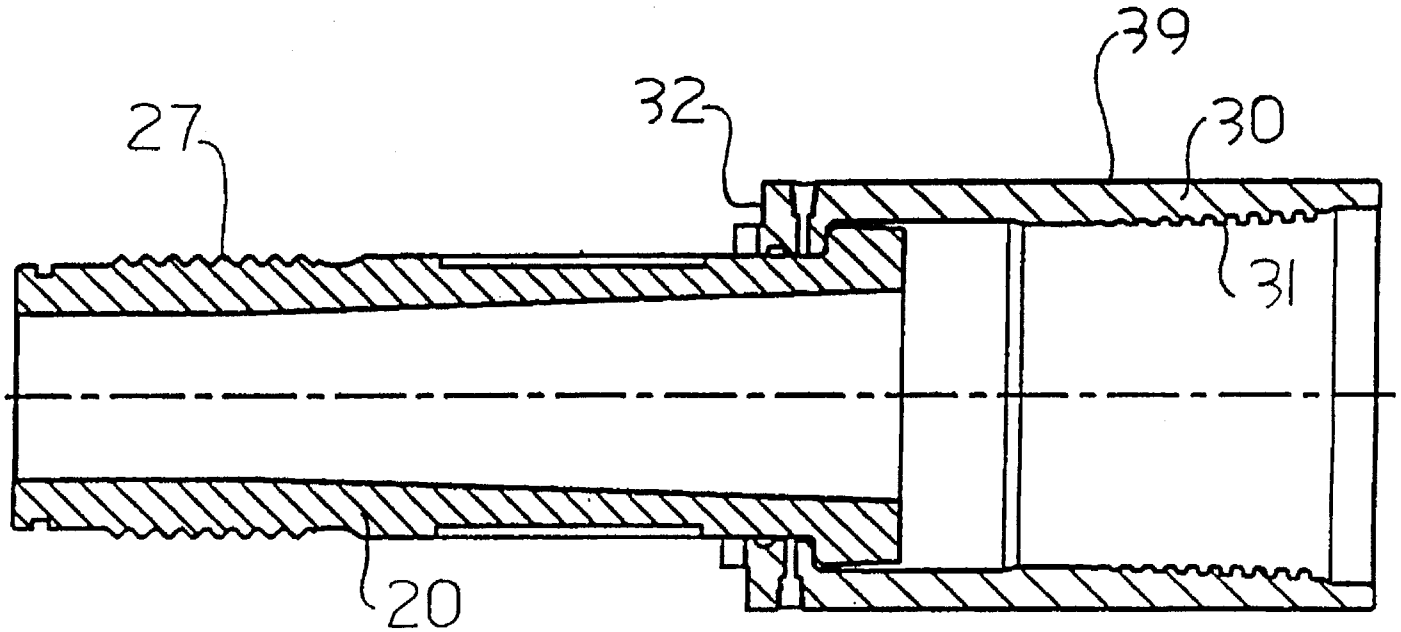
Figure 5A:
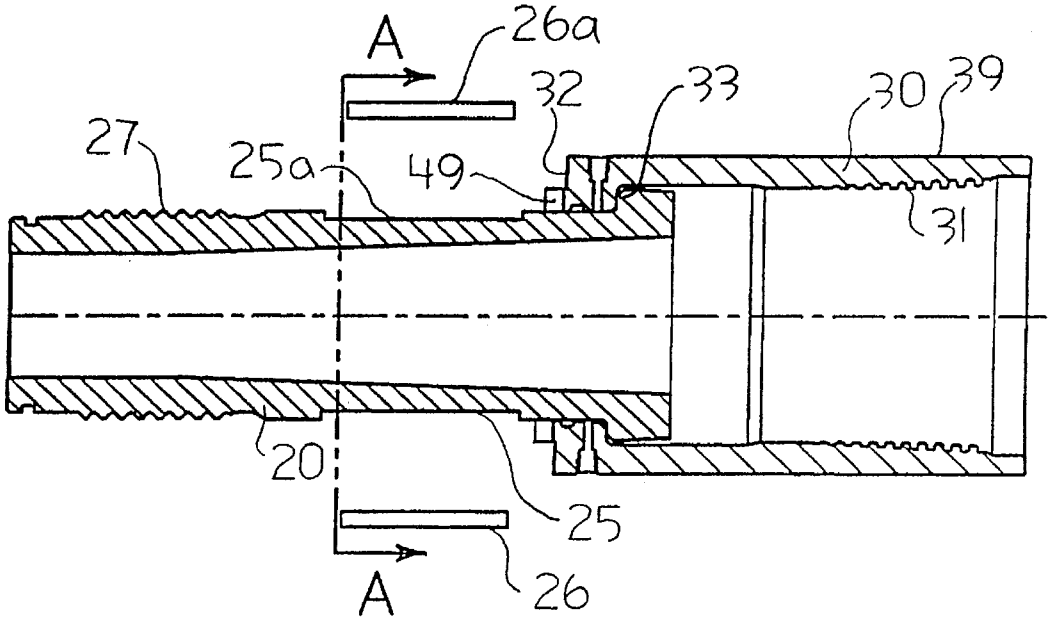
FIG. 5A is similar to FIG. 4 with keys shown.
Figure 5B:
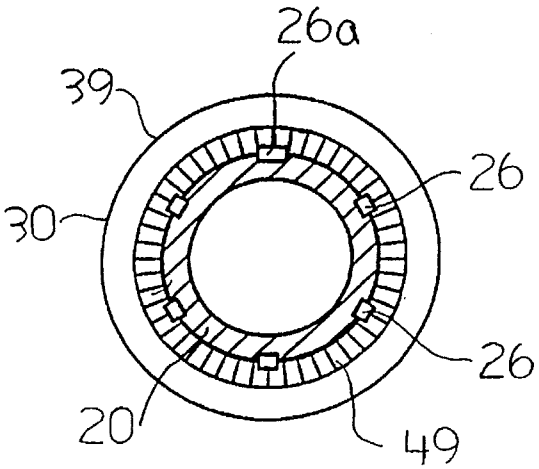
FIG. 5B is a cross-section showing mandrel, keys and housing according to the invention along the line A—A in FIG. 5A.
Figure 6A:
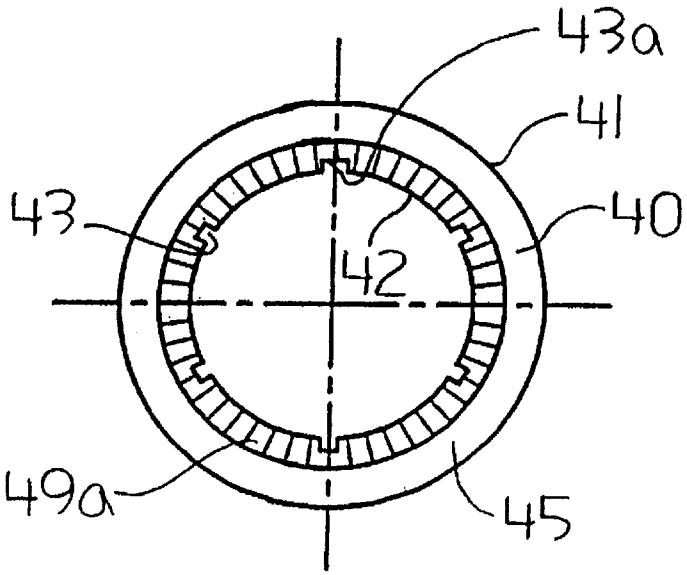
FIGS. 6A and 6B are respectively a cross-section and longitudinal section of the kick ring.
Figure 6B:
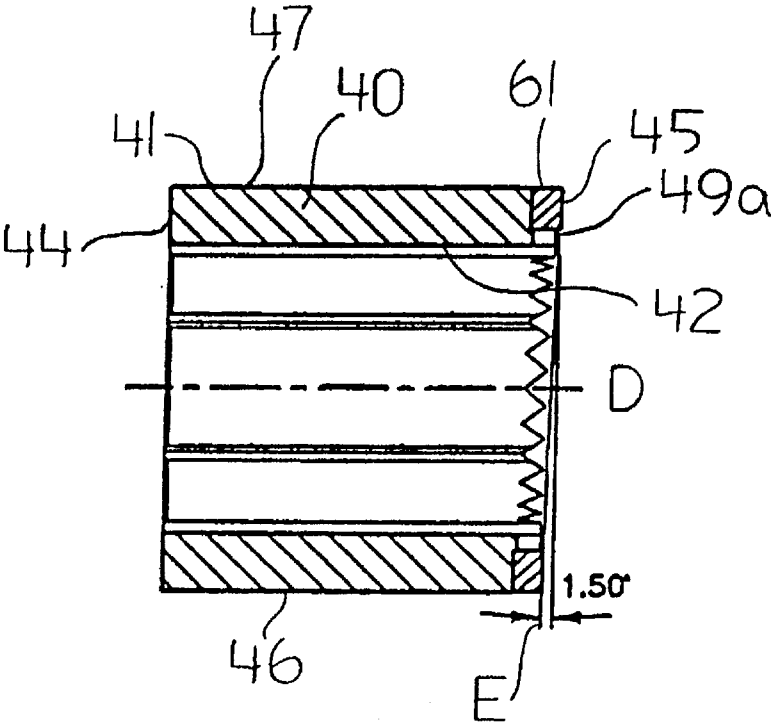
Figure 7:
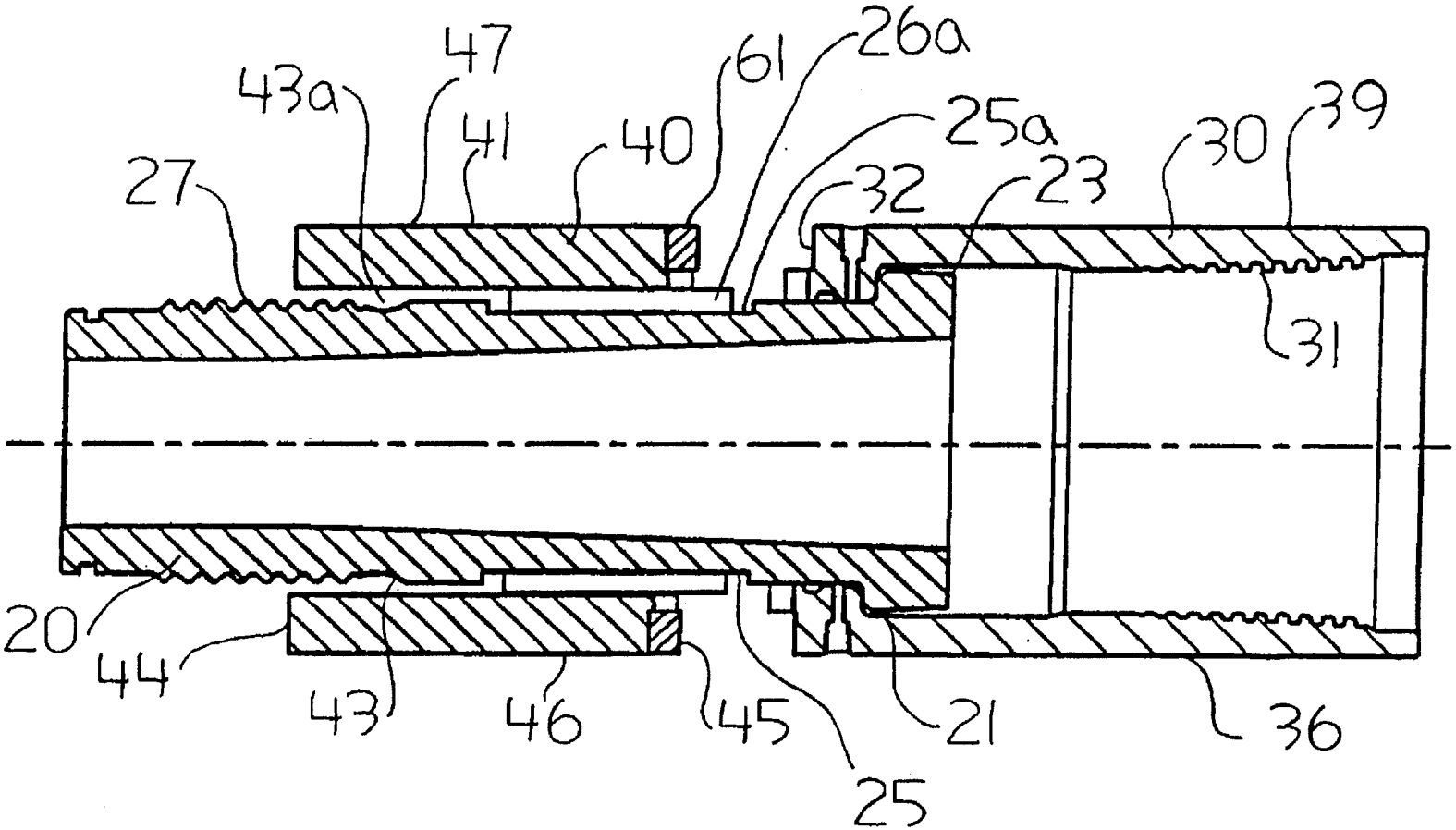
FIGS. 7 and 8 shows mandrel, keys, kick ring and housing according to the invention in adjustment and locking positions respectively.
Figure 8:
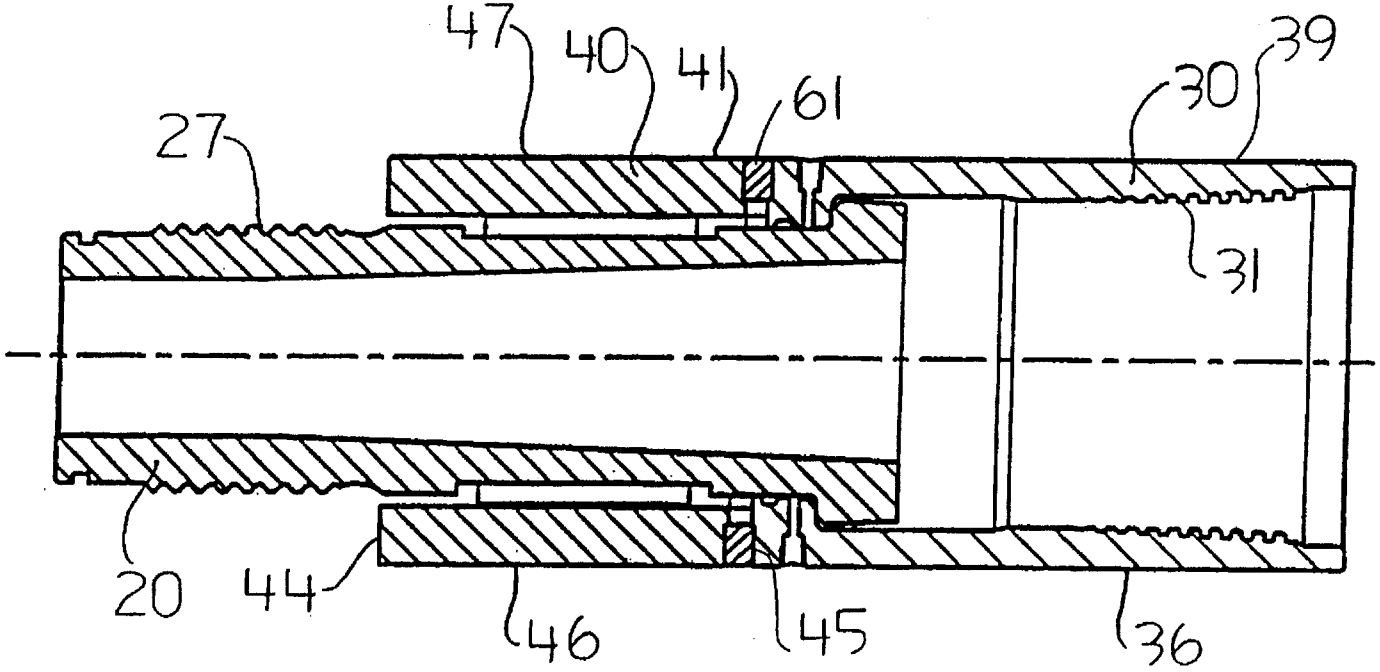

Mandrel 20 is a tube with a central axis A (FIG. 1A). The mandrel 20 has an outer shoulder 21 at one end, with the shoulder 21 facing the downward end (left side of FIG. 1A) of the apparatus. The face 22 of the shoulder 21 defines a plane whose normal is offset from the central axis A of the mandrel 20. (The normal of a plane is the line at right angles to the plane). The degree of offset can vary from assembly to assembly. For example, if the adjustable assembly were to be from 0 degrees to 3 degrees, this face would have to be machined at an angle of 1½ degrees. For an adjustable assembly from 0 degrees to 2 degrees, the face would have to be 1 degree. The face is machined at ½ the desired angle of the assembly. When this shoulder 21 is finished-machined, it will have a short side 23 and a long side 24. The exterior of the shaft, machined parallel to the center axis, has keyways 25 machined longitudinally in its surface to accept keys 26 to retain kick ring 40 in a desired position. The opposite end of the mandrel 20 (away from the shoulder 21) has a thread 27 or other locking device machined on it to engage mandrel head 50.

Housing 30 (may be referred to as a kick housing) is a dimensionally larger tube than the mandrel 20 so that the end of the mandrel 20 that includes the shoulder 21 fits inside at least one end of the housing 30. The housing 30 has an outer surface 39 parallel to the center axis of the tool, and an internal thread 31 at one end to adapt the adjustable assembly to a drill string or drill string assembly (not shown, but known in the art). A central axis B of the housing 30 is defined in relation to the outer surface of the housing. The thread 31 may be external. The housing 30 has a downward facing end face 32 defining a plane whose normal axis C is offset from the housing central axis, and an internal shoulder 33 adjacent the downward facing end face 32 is also machined off the perpendicular of the center axis and defines a face 38 parallel to the downward facing end face of the housing 30. In addition, the shoulder 33 as shown in FIGS. 2A, 2B, 3, 4 and 5A is parallel to the face 22 of the outer shoulder 21 of the mandrel 20. A conical internal bore 34 formed by the inner surface of the housing 30 is machined perpendicular to the end face 32 and opens away from the face at an included angle of at least the same as the total adjustment angle of the assembly. The end face 32 preferably includes some form of engaging devices 49 to lock it in position with the ring 40, such as mating grooves, teeth or projections. This mechanism is not absolutely necessary, but adds assurance of proper alignment and eliminates the possibility of the housing 30 rotating out of position. When the housing 30 is finish-machined, the housing will have a short side 35 and a long side 36. On the outer surface of the housing 30, around the circumference at the end face 32 end, small windows or marks 37 are milled in the surface around 90 degrees of the surface (see FIGS. 13A, 13B, 13C, 13D and 13F). The number of windows 37 will vary with the amount of change in bend required in the tool. For example, when looking directly at the end face 32, the first mark would be on the short side 35 and every other mark would revolve around the circumference so that the last mark would be 90 degrees away from the first. The maximum bend of the assembly would be marked in the first window and 0 degrees (straight) would be marked in the last.

In construction (see FIG. 3), the housing 30 is slid with internal thread 31 first on to the threaded end 27 of the mandrel 20. When the housing 30 is slid on all the way, the face of the shoulder 33 of the housing 30 comes in contact with the downward facing face 22 of the shoulder 21 of the mandrel 20. At this point in construction, keys 26 can be placed into the keyways 25 on the mandrel 20 as shown on FIG. 5A, 5B.

The ring 40 is a tube, with a central axis D and outer surface 41 and inner bore 42 both parallel to the central axis. The ring 40 preferably has the same outside diameter as the housing 30 and is dimensioned to fit over and slide on the mandrel 20. Keyways 43 are machined longitudinally along bore 42 to accept the keys 26 for guiding the ring 40 longitudinally but not circumferentially on the mandrel 20. One keyway **43*a* is oversize for proper alignment. The ring 40 has a downward facing end face 44 machined perpendicular to the center axis and an upward facing bevelled end face 45 at the opposite end machined off the perpendicular of the center axis at the same angle as the outer shoulder 21 of the mandrel 20. In the example shown, the bevelled end face 45 is formed of a ring 61 as shown such that axial loads are borne across the end face 45 rather than across the teeth 49*a*. The normal of the plane defined by the end face 45 is thus offset from the ring central axis. The ring end face 45 preferably has some form of engaging devices 49*a*, such as previously described in relation to the housing, complimentary to the engaging devices on the end face of the housing 30 to lock the ring 40 to the housing 30 against rotation movement when they are pressed together. The engaging device 49s/49*a*** add assurance of proper alignment.

When the ring 40 is finished-machined, it will have a short side 46 and a long side 47. On the outer surface 41, around the circumference at the end face 45, small windows 48 are milled in the surface around 90 degrees of the surface (see FIGS. 13A, 13B, 13C, 13D and 13E). The number of windows (marks) 48 will vary with the amount of change in bend required in the tool. For example, when looking directly at the end face 45 of the ring 40, the first mark 48 may be on the short side 46 and every other mark would revolve around the circumference so that the last mark would be 90 degrees away from the first. The maximum bend of the assembly would be marked in the first window and 0 degrees (straight) would be marked in the last. The placement of the windows is identical on both the housing 30 and the ring 40.

The ring 40 is slid on to the mandrel 20 from the threaded end 27 of the mandrel 20, bevelled end face 45 first. For ease of assembly, one keyway **25*a* may be machined to accept a larger key 26*a*. This keyway 25*a* may be placed in such a way as to line up the long side 47 of the ring 40 with the short side 23 of the shoulder 21. The keyways 25, 43 on the mandrel 20 and ring 40 respectively are lined up to allow the oversize key 26*a* into the oversize keyways 25*a*, 43*a*. When slid on, the bevelled end face 45 of the ring 40 and the end face 32 of the housing 30** butt up to one another.

Figure 9:
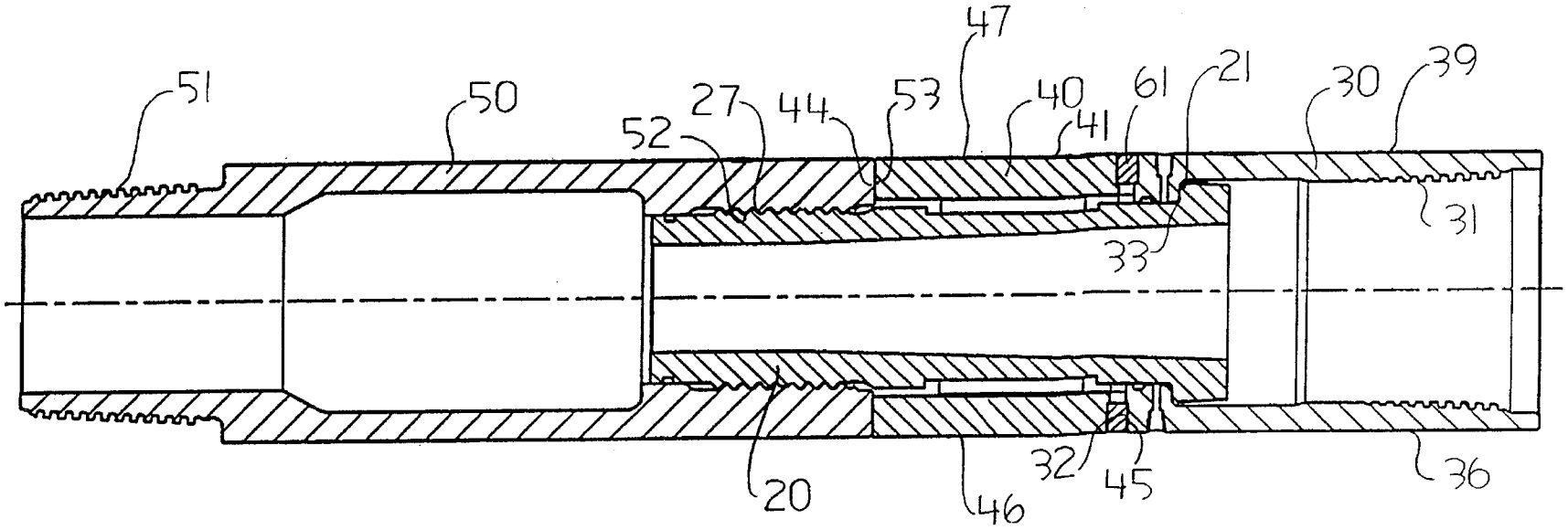
FIG. 9 shows mandrel, mandrel head, keys, kick ring and housing according to the invention in locked straight position.
Figure 13A:
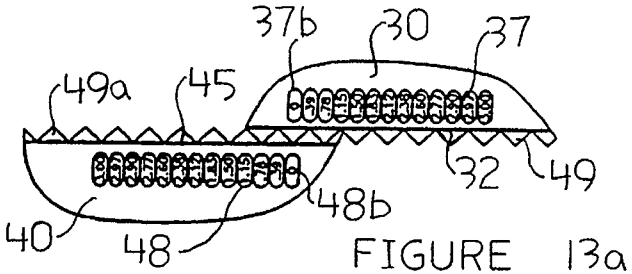
FIGS. 13A, B, C, D, E and F show adjustment markings for the apparatus of FIG. 9.

The mandrel head 50 is a tube preferably having an external surface the same outside diameter as the ring 40 and housing 30, and an external thread 51 at one end to adapt the adjustable assembly to a conventional drill string or drill string assembly (not shown). The external thread 51 may be internal. The opposite end of the mandrel head 50 has an internal thread 52 to adapt it to the mandrel 20. The mandrel head 50 is screwed onto the mandrel 20 and, when fully engaged, the end face 53 of the mandrel head 50 will butt up to the downward facing end face 44 of the ring 40 and lock the adjustable assembly. Screwing of the mandrel head 50 onto the mandrel 20 forces the ring 40 into engagement with the housing 30 and the shoulder 21 of the mandrel 20 into engagement with the shoulder 33 of the housing 30. Unscrewing disengages these respective parts. FIG. 9 shows the tool in locked or engaged position with the mandrel head 50 threaded fully on to the mandrel 20 forming a straight tool. The corresponding engagement of the faces 32 and 45 and markings 37 and 48 is shown in FIG. 13A.

Figure 10:
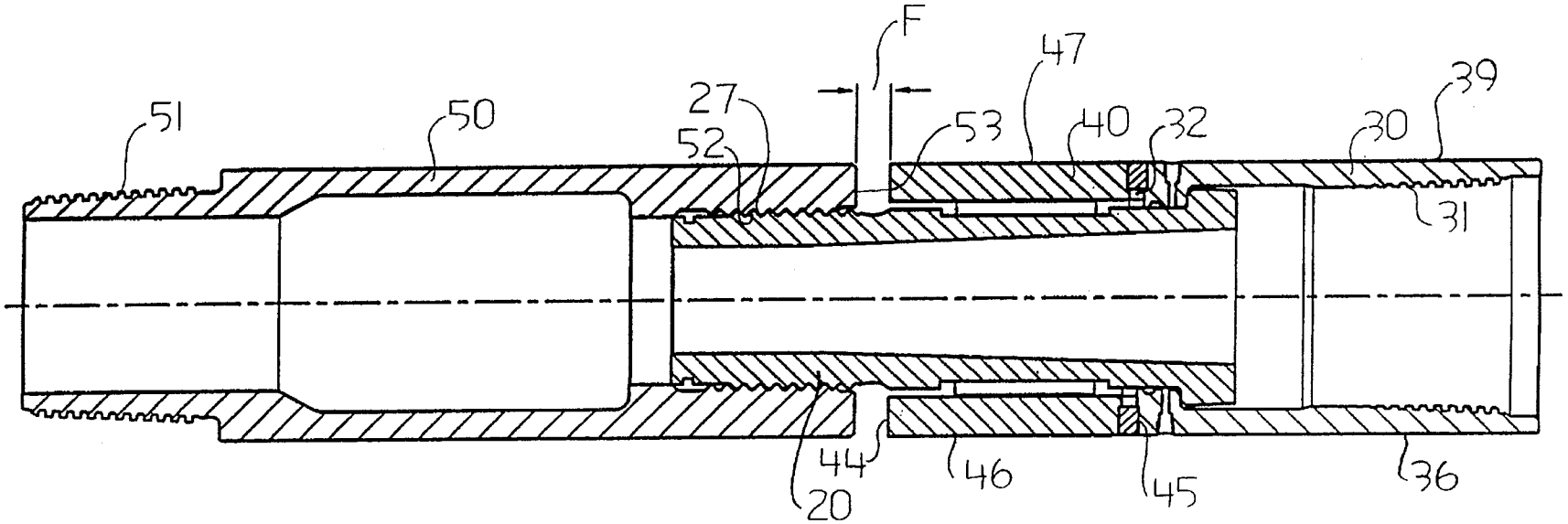
FIGS. 10 and 11 show stages of adjustment of the apparatus of FIG. 9.
Figure 11:
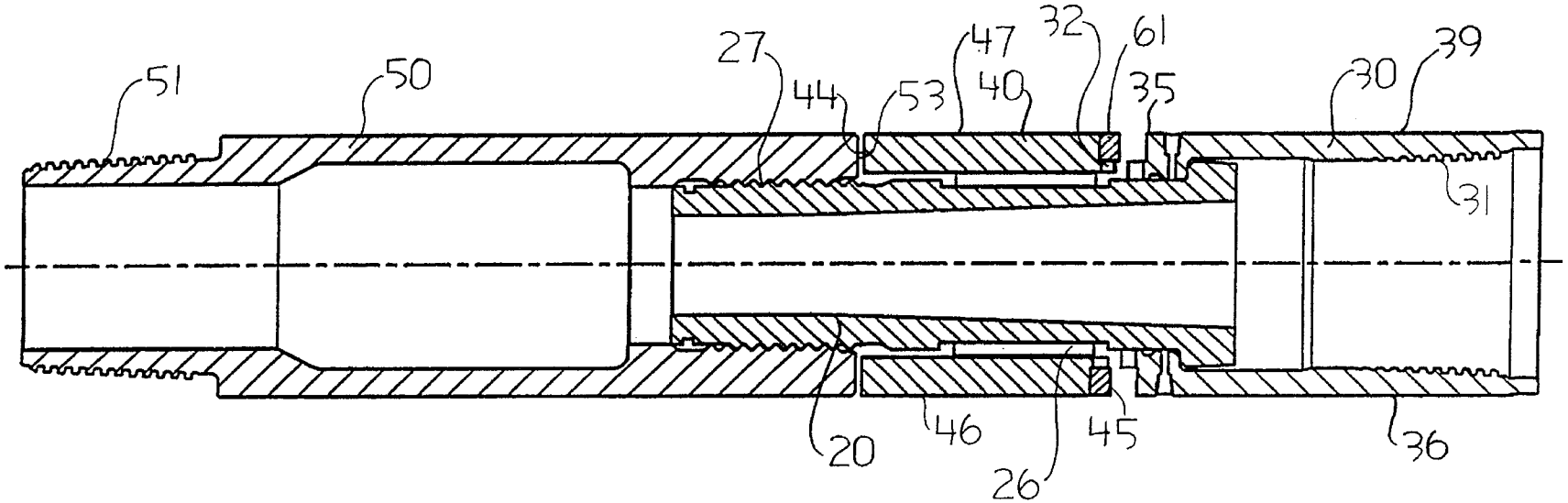
Figure 12:
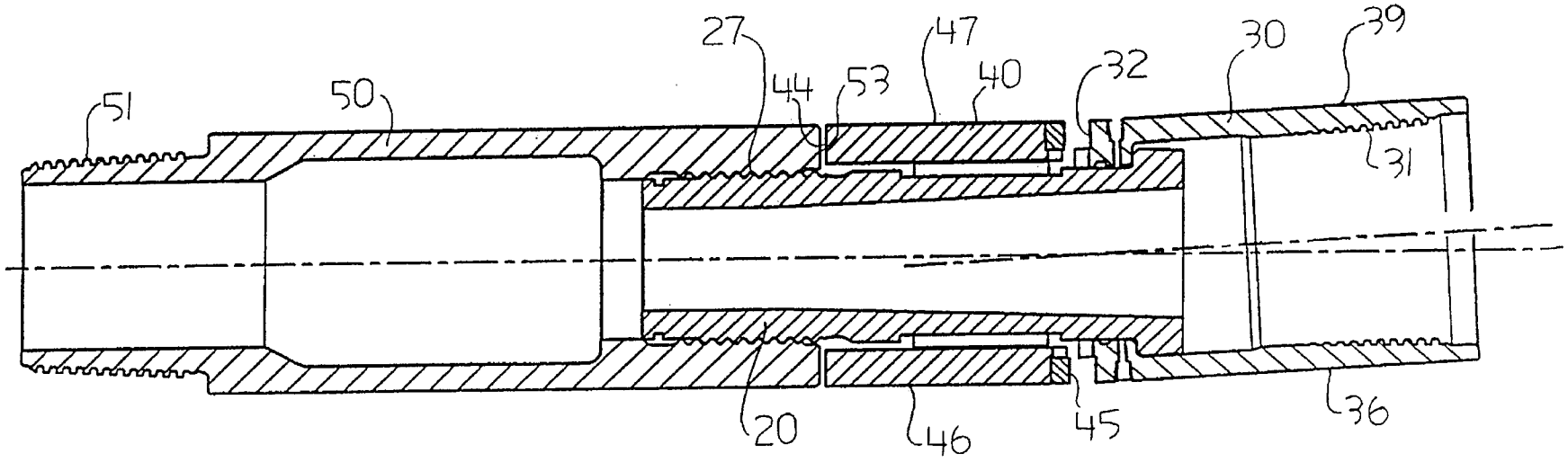
FIG. 12 shows the apparatus of FIG. 9 during rotation to an adjusted position.
Figure 13B:
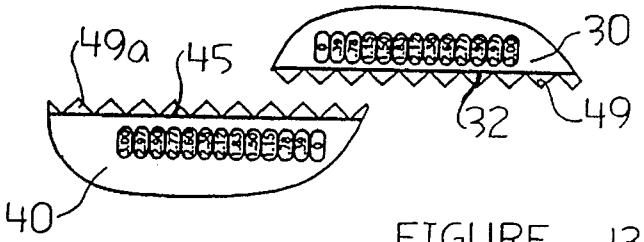
Figure 13C:
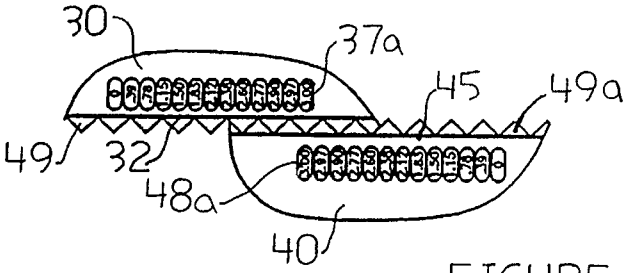
Figure 13D:
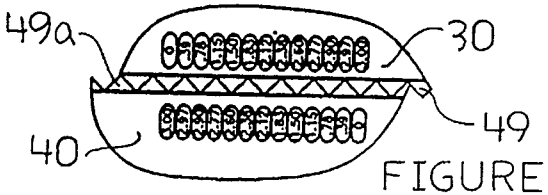
Figure 13E:
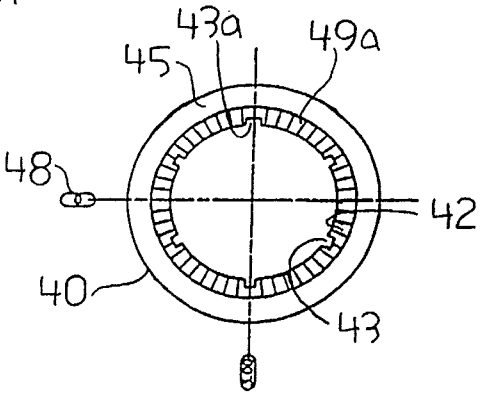
Figure 13F:
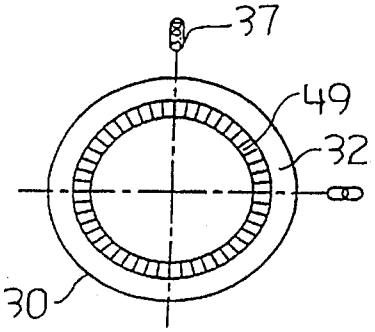
Figure 14:
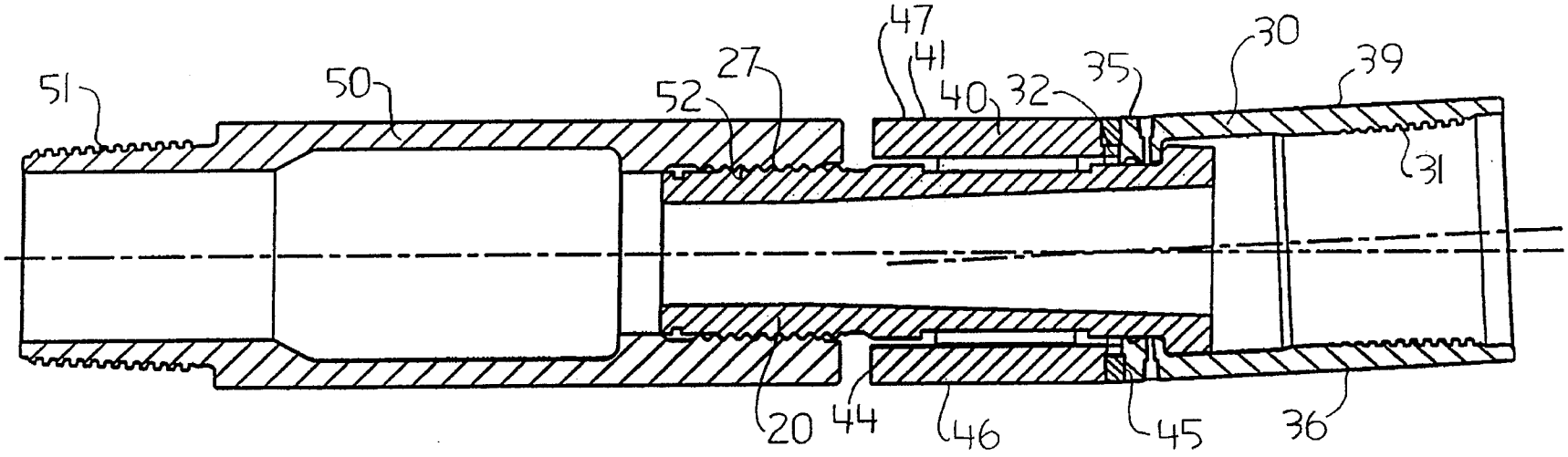
FIG. 14 shows the apparatus of FIG. 9 in bent position immediately prior to locking.

For adjustment, the mandrel head 50 is screwed partially back off the mandrel 20 to create a gap F of slightly more than the depth of any protrusions or other locking feature between the end faces 32 and 45 of the housing 30 and ring 40 respectively. The backing off of the mandrel head 50 is shown in FIG. 10. The ring 40 is slid back along the keys 26 until the downward facing end face 44 of the ring 40 and the end face 53 of the mandrel head 50 come in contact, creating a gap between the ring 40 and the housing 30, as shown in FIGS. 11 and 13B. The housing 30 is rotated around to a predetermined angle as shown in FIG. 12 and as determined by the markings 37 and 48 (shown in FIGS. 13A, 13B, 13C, 13D, 13E and 13F). Once the appropriate markings have been aligned, the ring 40 is slid against the housing 30 with their respective faces 45 and 32 abutting each other. An appropriate angle is achieved when the angle required, which will appear in one of the windows 37 on the housing 30, lines up with the same angle marked in a corresponding window 48 on the ring 40. For example, when a setting of 3 degrees is required, window 37*a* on the housing 30 marked 3.00 will be rotated around to line up with window 48*a* on the ring 40 marked 3.00, as shown in FIG. 13C. With a setting of 0 degrees (straight), window 37*b* marked 0 on the housing 30 will be rotated around to line up with corresponding window 48*b* of the ring 40 marked 0 as shown in FIG. 13A. An intermediary position (2.12 degrees) is shown in FIG. 13D.

Figure 15:
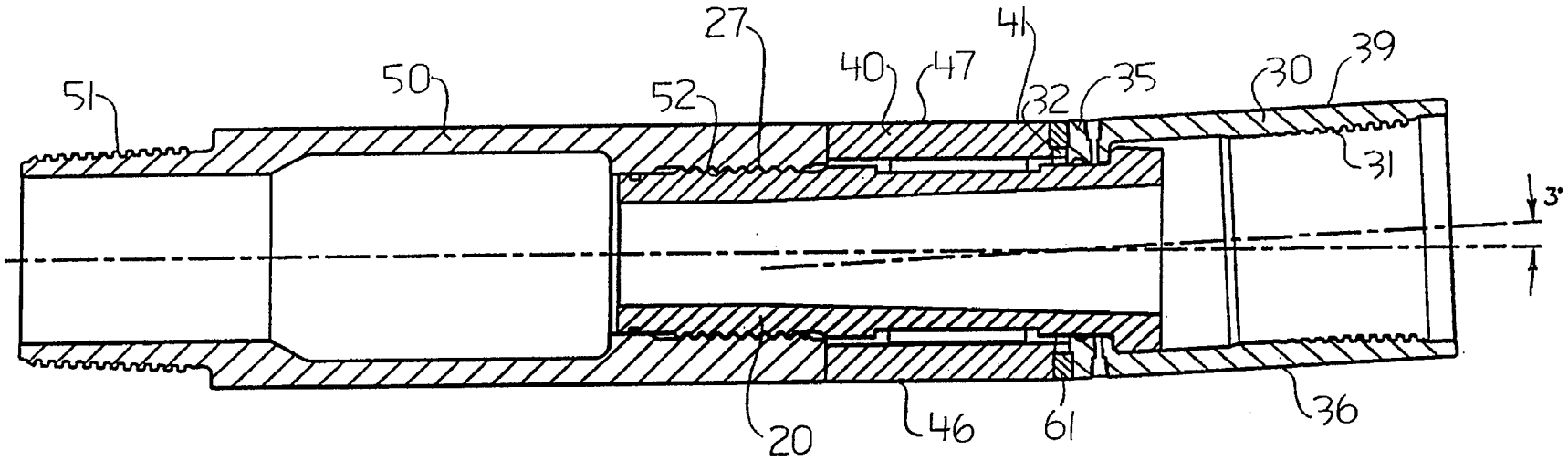
FIG. 15 shows the apparatus of FIG. 9 in bent locked position.

After the desired setting is achieved with the ring 40 slid back to its original position, engaging any locking devices on the facing end faces 32 and 45 and abutting these faces 32 and 45 against each other, the mandrel head 50 is then screwed back to butt against the end face 44 of the ring 40, which will lock the assembly in position and ready it for use as shown in FIG. 15.

A person skilled in the art could make immaterial modifications to the invention described and claimed in this patent without departing from the essence of the invention.

The embodiments of the invention in which an exclusive property or privilege is claimed are defined as follows:

1. An adjustable bent housing for use in downhole drilling, the adjustable bent housing comprising:

a housing having a housing central axis and a downward facing end face defining a plane whose normal is offset from the housing central axis, the housing also having an inner shoulder parallel to the downward facing end face;

a mandrel having a mandrel central axis and a first end dimensioned to fit inside the housing, the first end of the mandrel having a downward facing outer shoulder defining a plane whose normal is offset from the mandrel central axis;

a ring axially slidable on the mandrel, the ring having a ring central axis and an upward facing end face defining a plane whose normal is offset from the ring central axis; and locking means connectable to the mandrel for engaging and disengaging the upward facing end face of the ring with the downward facing end face of the housing and simultaneously engaging and disengaging the inner shoulder of the housing with the outer shoulder of the mandrel.

2. The adjustable bent housing of claim 1 in which the locking means is a mandrel head connectable to the mandrel.

3. The adjustable bent housing of claim 2 in which the mandrel head is threadably connectable to the mandrel.

4. The adjustable bent housing of claim 1 further including ring position selection means permitting engagement of the ring on the mandrel in designated circumferential positions only.

5. The adjustable bent housing of claim 1 further including keys disposed between the ring and mandrel to confine the ring to axial movement in relation to the mandrel.

6. The adjustable bent housing of claim 5 further including at least one of the keys being differently sized from other keys to thereby permit engagement of the ring on the mandrel in selected circumferential positions only.

7. The adjustable bent housing of claim 1 further including markings on the ring adjacent the upward facing end face and on the housing adjacent the downward facing end face to indicate relative degrees of rotation of the ring in relation to the housing.

* * * * *